US009333145B2

(12) United States Patent
Cho et al.

(10) Patent No.: US 9,333,145 B2
(45) Date of Patent: May 10, 2016

(54) METHOD FOR NECK CARE, AND NECK CARE KIT COMPRISING THE METHOD

(75) Inventors: Ga Young Cho, Cheongju-si (KR); Eun Joo Kim, Suwon-si (KR); Ho Sik Rho, Yongin-si (KR); Duck Hee Kim, Seoul (KR); Han Kon Kim, Suwon-si (KR)

(73) Assignee: AMOREPACIFIC CORPORATION (KR)

( * ) Notice: Subject to any disclaimer, the term of this patent is extended or adjusted under 35 U.S.C. 154(b) by 638 days.

(21) Appl. No.: 13/392,192

(22) PCT Filed: Aug. 24, 2010

(86) PCT No.: PCT/KR2010/005640

§ 371 (c)(1),
(2), (4) Date: Feb. 24, 2012

(87) PCT Pub. No.: WO2011/025223

PCT Pub. Date: Mar. 3, 2011

(65) Prior Publication Data

US 2012/0158042 A1 Jun. 21, 2012

(30) Foreign Application Priority Data

Aug. 31, 2009 (KR) ..... 10-2009-0081200

(51) Int. Cl.
*A61H 99/00* (2006.01)
*A61H 39/04* (2006.01)
*A61H 23/06* (2006.01)

(52) U.S. Cl.
CPC ..... *A61H 99/00* (2013.01); *A61H 39/04* (2013.01); *A61H 23/06* (2013.01)

(58) Field of Classification Search
CPC ..... A61H 39/04; A61H 39/08; A61H 39/086; A61H 39/02; A61H 39/00; A61H 2201/1695; A61H 2205/04; A61H 99/00; A61H 23/06
USPC ..... 606/204; 601/134
See application file for complete search history.

(56) References Cited

U.S. PATENT DOCUMENTS 4,352,491 A * 10/1982 Bellia ..... 482/142
6,149,610 A * 11/2000 Urko ..... 601/15

(Continued)

FOREIGN PATENT DOCUMENTS

CN 1215326 A 4/1999
JP 2004-105479 A 4/2004

(Continued)

OTHER PUBLICATIONS

Office Action from corresponding Chinese Application No. 201080049137.6 (mailed Sep. 2, 2013).

(Continued)

*Primary Examiner* — Jocelin Tanner
(74) *Attorney, Agent, or Firm* — Merchant & Gould P.C.

(57) ABSTRACT

Provided are a method for neck care and a neck care kit comprising the method, the method comprising: the step of applying acupressure to a Cheonchu acupoint and then applying acupressure downward along a back neckline from the Cheonchu acupoint; the step of applying acupressure to a Yepung acupoint and then applying acupressure downward along the sternocleidomastoid muscle from the Yepung acupoint to the upper margin of the collarbone; the step of applying acupressure to the upper margin of the collarbone and the decollete region (the upper part of breast); and the step of applying acupressure to the region connecting the low margin of the lower jaw and the neck. The method for neck care is considered to have effects of relieving skin wrinkles, improving blood circulation, relieving tension and giving a pleasant stimulation, thereby enabling various applications in the fields of skin care, cosmetics and medicine.

4 Claims, 3 Drawing Sheets

(56) References Cited

U.S. PATENT DOCUMENTS

| | | | | |
|---|---|---|---|---|
| 2004/0151793 | A1* | 8/2004 | Paspaleeva-kuhn et al. | 424/754 |
| 2004/0158181 | A1* | 8/2004 | Watanabe et al. | 601/99 |
| 2005/0101886 | A1 | 5/2005 | Shimagami et al. | |
| 2006/0095087 | A1* | 5/2006 | Shin | 607/46 |
| 2007/0054253 | A1* | 3/2007 | Imanishi et al. | 434/262 |
| 2008/0269028 | A1* | 10/2008 | Hunter | A61H 1/0237 482/91 |
| 2009/0098213 | A1* | 4/2009 | Tran | 424/526 |
| 2009/0177129 | A1* | 7/2009 | Chan et al. | 601/112 |

FOREIGN PATENT DOCUMENTS

| | | | |
|---|---|---|---|
| JP | 2004-129705 | A | 4/2004 |
| JP | 2004-196734 | | 7/2004 |
| JP | 2008-068105 | A | 3/2008 |
| JP | 2008-086781 | A | 4/2008 |
| KR | 10-2002-0097141 | | 12/2002 |
| KR | 10-2009-0034241 | | 4/2009 |

OTHER PUBLICATIONS

"Easy Massage Treatment," pp. 180-182 (2004) (China).

International Search Report for corresponding International Application No. PCT/KR2010/005640 (Form PCT/ISA/210) (Mar. 29, 2011).

Office Action from corresponding Japanese Patent Application No. JP 2012-526635 (mailed Apr. 8, 2014).

Office Action from Korean Patent Application No. 10-2009-0081200 (mailed Nov. 12, 2015).

* cited by examiner

Before neck care After neck care

METHOD FOR NECK CARE, AND NECK CARE KIT COMPRISING THE METHOD

This application is a U.S. National Stage Application under 35 U.S.C. §371 of International Patent Application No. PCT/KR2010/005640, filed 24 Aug. 2010, which claims the benefit of priority to Korean Patent Application No. 10-2009-0081200, filed 31 Aug. 2009, the disclosures of all of which are hereby incorporated by reference in their entireties. The International Application was published in Korean on 3 Mar. 2011 as WO 2011/025223. To the extent appropriate, a claim of priority is made to each of the above disclosed applications.

TECHNICAL FIELD

The present disclosure relates to a method and a kit for neck care specialized for neck.

BACKGROUND

Manual therapy refers to a physical treatment performed by a therapist to stimulate the body surface with hands and control the meridians. The history of the manual therapy is very long and it has been widely used until now owing to easy operation, fast effect and needlessness of many tools. The manual therapy is called and classified differently, and includes tui na, acupressure, massage, chiropractic, bodywork, or the like. Especially, the French word massage means "rubbing" and is derived from a Greek word meaning "rubbing or pressing as if washing one's hair".

The manual therapy is effective in regulating yin and yang, connecting the meridians and circulating qi and blood. In addition, it is known to be effective in promoting blood circulation and removing blood stasis, removing tumor and relieving pain, lubricating joints, and strengthening muscles and bones. Mechanically, massage helps venous blood flow, promotes lymphatic flow, reduces edema, and relaxes tissues.

The manual therapy may be utilized for skin care. The neck skin is less resistant external stimulation than the face skin. Also, the neck skin tends to show rapid increase in damage of barrier function represented by the transepidermal water loss (TEWL) with aging. In addition, excessive stimulation to or wrong massage on the neck may result in stress to the neck skin.

Accordingly, a specialized manual therapy is necessary for the neck. Especially, when skin cosmetics are used for the neck skin, a method capable of enhancing the effect of the cosmetics while minimizing stress to the skin is required.

SUMMARY OF THE INVENTION

Technical Problem

The present disclosure is directed to providing an effective method for neck care.

The present disclosure is also directed to providing a neck care kit.

Technical Solution

In one general aspect, the present disclosure provides a method for neck care comprising: the step of applying acupressure to a Cheonchu acupoint and then applying acupressure downward along a back neckline from the Cheonchu acupoint; the step of applying acupressure to a Yepung acupoint and then applying acupressure downward along the sternocleidomastoid muscle from the Yepung acupoint to the upper margin of the collarbone; the step of applying acupressure to the upper margin of the collarbone and the decollete region (the upper part of breast); and the step of applying acupressure to the region connecting the low margin of the lower jaw and the neck. In another general aspect, the present disclosure provides a neck care kit comprising the method for neck care and a neck cream.

Advantageous Effects

The method for neck care according to the present disclosure has effects of relieving skin wrinkles, improving blood circulation, relieving tension and giving a pleasant stimulation.

DETAILED DESCRIPTION

Figure 1:
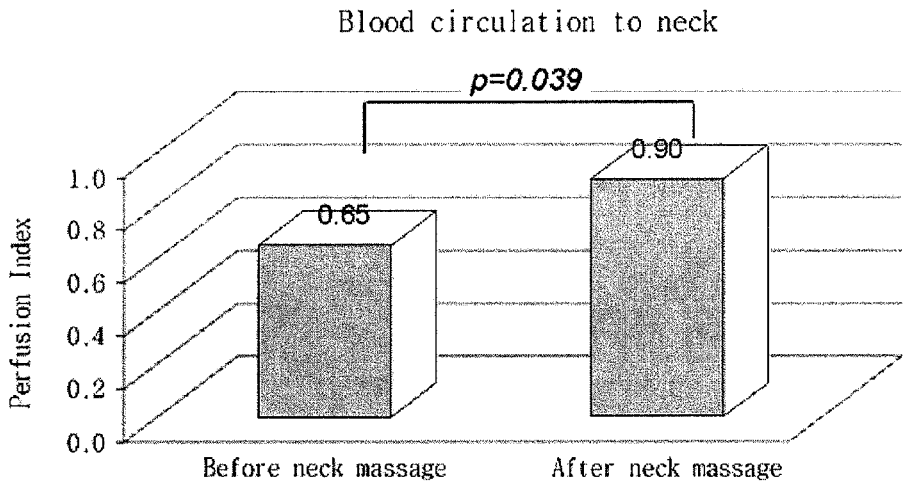
FIGS. 1 and 2 respectively show the change in blood circulation to the neck and face after performing neck care according to an embodiment of the present disclosure.

The method for neck care according to the present disclosure is a beauty care method specialized for care of the neck skin. The method for neck care may be performed either by a therapist or by oneself. Specifically, the method for neck care according to the present disclosure can provide significantly improved beauty care effect specialized for neck skin by applying acupressure along muscles and lymphatic flow. Also, in addition to relieving skin wrinkles on the neck, it helps to maintain or improve the skin condition of the face by improving blood circulation to the face. Furthermore, the neck care provides good relaxation effect and gives comforting, pleasant stimulation.

In an exemplary embodiment, the method for neck care according to the present disclosure may comprise:

(a) a step of applying acupressure to a Cheonchu acupoint and then applying acupressure downward along a back neckline from the Cheonchu acupoint;

(b) a step of applying acupressure to a Yepung acupoint and then applying acupressure downward along the sternocleidomastoid muscle from the Yepung acupoint to the upper margin of the collarbone;

(c) a step of applying acupressure to the upper margin of the collarbone and the decollete region (the upper part of breast); and (d) a step of applying acupressure to the region connecting the low margin of the lower jaw and the neck.

Hereinafter, the individual steps of the method for neck care according to the present disclosure will be described in detail.

In the step (a), stimulation is applied to the back portion of the neck of a subject to make respiration even and relax the skin and tissues of the neck. A therapist may apply acupressure by pressing with palms or fingers. Specifically, after straightening the posture of the subject, acupressure is applied to the Cheonchu acupoints located on both sides of the spinous processes of the second cervical vertebra with both hands. The Cheonchu acupoint is pressed 3-10 times, more specifically 6 times. Then, acupressure is applied downward along a back neckline from the Cheonchu acupoint.

In the step (b), acupressure is applied to a Yepung acupoint and then downward along the sternocleidomastoid muscle from the Yepung acupoint to the upper margin of the collarbone. The Yepung acupoint, i.e. the depression below the mastoid process of the subject, is pressed 3-10 times, more specifically 6 times. Then, acupressure is applied downward along the sternocleidomastoid muscle from the Yepung acupoint to the upper margin of the collarbone by applying stimulation, from up to down. For example, the acupoints on the sternocleidomastoid muscle—Cheonchang acupoint, Cheonyong acupoint and Cheonyu acupoint—may be sequentially pressed. This step is to stimulate the sternocleidomastoid muscle of the neck which is main muscle in neck region so as to improve blood circulation to the neck and face and relieve wrinkles on the neck skin.

In the step (c), acupressure is applied to the upper margin of the collarbone and the decollete region (the upper part of breast). That is to say, acupressure is applied to the upper margin of the collarbone and the decollete region including the clavicular division of the sternocleidomastoid muscle. When the subject massages oneself, he/she may symmetrically press the upper margin of the collarbone by crossing his/her hands. This step is to stimulate and relax the sternocleidomastoid muscle and the platysma muscle so as to improve the elasticity of the neck skin.

Next, in the step (d), acupressure is applied to the region connecting the low margin of the lower jaw and the neck. Specifically, acupressure is applied to the region connecting the low margin of the lower jaw and the neck including the digastric muscle using thumbs with a gap of about 2 cm from the centerline. This step is to prevent the drooping of the neck skin and shaping the neckline.

The method for neck care according to the present disclosure may further comprise a step of applying a neck cream on the neck before the step (b). For example, the neck cream is applied uniformly on the whole neck of the subject, from down to up in a clockwise direction. After applying the neck cream, the neck skin is patted slightly in order to facilitate absorption and tense up the muscle.

The neck cream is not specially limited and may be a cosmetic composition for neck skin used for massaging, relieving wrinkles, stretching, whitening, or the like. In an exemplary embodiment, the neck cream comprises one or more selected from a group consisting of foxglove extract, licorice extract, coix seed extract, malt extract, quince extract, acanthopanax extract and arrowroot extract as an active ingredient. The neck cream has effects of improving skin elasticity, relieving skin wrinkles and preventing skin aging. More specifically, the composition one or more selected from a group consisting of foxglove extract, licorice extract, coix seed extract, malt extract, quince extract, acanthopanax extract and arrowroot extract as an active ingredient promotes differentiation of preadipocytes to adipocytes and increases the number and size of produced lipid droplets. Thus, by promoting differentiation into adipocytes and production of lipid droplets, the composition increases skin fineness, thereby relieving skin wrinkles, improving skin elasticity and preventing skin aging. Each extract provides the above effects and better effects can be achieved when the extracts are used in combination. The neck cream may be in any form without particular limitation, including, for example, cream, gel, foam, lotion, etc.

The method for neck care according to the present disclosure may be performed by a therapist either on a subject or on the therapist oneself. Accordingly, the neck care may be performed in a skin care shop or at home.

The present disclosure further provides a neck care kit comprising an instruction describing the method for neck care and a neck cream composition. A user who purchases the neck care kit may perform the neck care according to the instruction and the enclosed neck cream composition will provide an improved effect of massage.

MODE FOR INVENTION

The examples and experiments will now be described. The following examples and experiments are for illustrative purposes only and not intended to limit the scope of this disclosure.

Test Example 1

Improvement of Blood Circulation to Neck and Face by Neck Care

Improvement of blood circulation to the neck and face by neck care was evaluated for 6 subjects. The subjects were randomly subjected from those who were aged in their 20s and 30s. After performing the neck care according to the present disclosure on the subjects, the change in blood circulation before and after the care was measured by laser Doppler perfusion imaging (LDPI; Perimed AB, Sweden). The result is shown in FIGS. 1-3.

Figure 2:
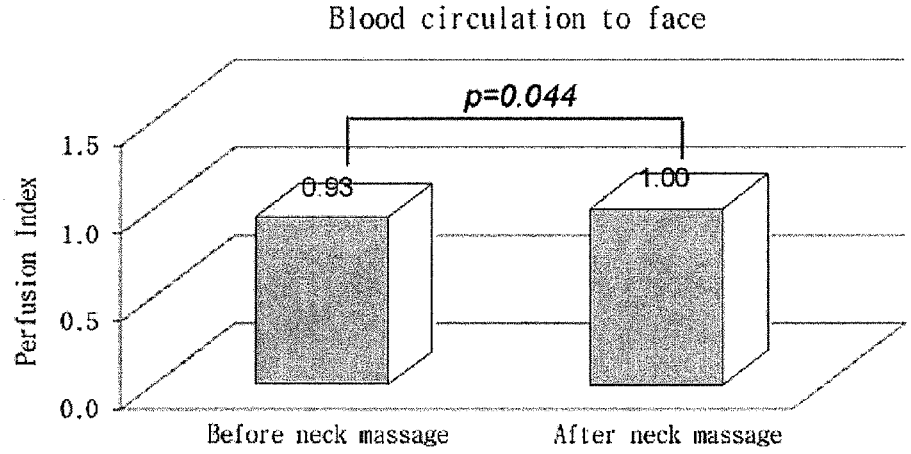

FIGS. 1 and 2 show the change in blood circulation to the neck and face, respectively. The blood circulation to the neck increased significantly after the care compared to before the care. Also, an increase of blood circulation to the face was observed. Accordingly, it can be seen that the method for neck care according to the present disclosure can improve face skin such as complexion of the face only by stimulating the neck.

Figure 3:
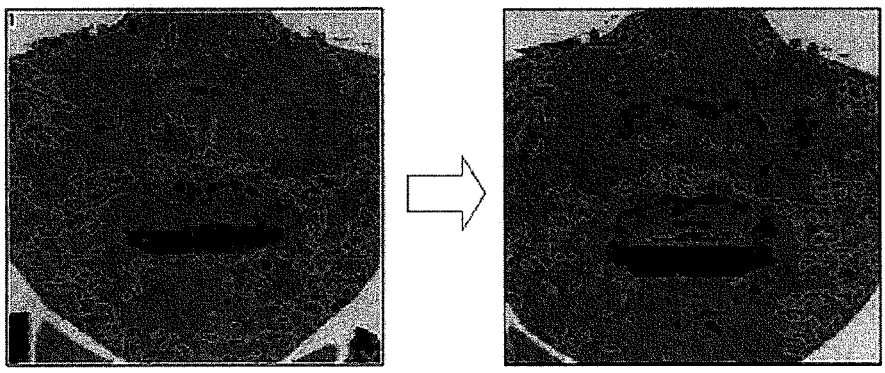
FIG. 3 shows temperature distribution on the face imaged using a thermal infrared camera before and after neck care.

FIG. 3 shows temperature distribution on the face before and after neck care. It can be seen that the temperature of the face increased after the neck care. This is because the blood circulation to the face was improved by the neck care. Accordingly, the temperature distribution is increased overall.

Test Example 2

Improvement of Wrinkles on Neck

Improvement of wrinkles on the neck was evaluated for 10 subjects. The subjects were randomly subjected from those who were aged in their 30s. Test was performed for 8 weeks by applying only a neck cream (non-massage group) or applying a neck cream and performing neck massage (massage group). Giyukhwan™ (AmorePacific, Korea) was used as the neck cream.

On weeks 4 and 8 after starting the test, image analysis on neck wrinkles was conducted by the PRIMOS-dedicated software PRIMOS version 5.04 after measuring the certain region using the Phaseshift Rapid In vivo Measurement of the Skin (PRIMOS, GFMesstechnik GmbH, Germany). The result is shown in FIG. 4.

Figure 4:
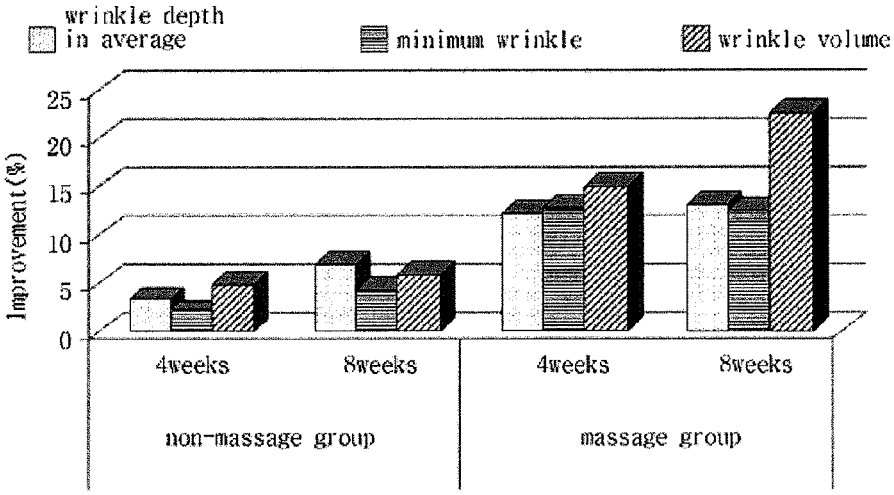
FIG. 4 shows the effect of relieving neck skin wrinkles of neck care performed according to an embodiment of the present disclosure.

As seen from FIG. 4, the neck care group showed much better improvement in neck wrinkles on week 8 after starting the test. Especially, whereas the non-massage care group showed improvement in wrinkle volume of about 5%, the massage group showed improvement of 21%, more than about 400% as compared to the non-massage group.

Test Example 3

Relaxation of Sympathetic Nerves by Neck Care

The autonomic nerves consist of sympathetic nerves and parasympathetic nerves. The sympathetic nerves stimulate activities associated with the stress response, facilitate excitement, and deal with a crisis. And, the parasympathetic nerves are known to protect internal organs and be responsible for maintenance of body resources, recovery, well-being and rest.

The effect of the neck care on relaxation of sympathetic nerves was tested on 9 subjects. The subjects were randomly subjected from those who were aged in their 20s and 30s.

Heart rate variability (HRV) was measured to compare tension before and after the neck care. TAS9 (Iem Bio, Korea) was used for the HRV measurement and the activity/balance of the sympathetic nerves and parasympathetic nerves was computed.

The test result is shown in Table 1. As seen from Table 1, the stimulation of the sympathetic nerves indicating the tension status decreased by 18.3% on average after the neck care.

TABLE 1

| | Before neck care | | After neck care | |
|---|---|---|---|---|
| Subjects | Sympathetic nerves | Parasympathetic nerves | Sympathetic nerves | Parasympathetic nerves |
| #1 | 44 | 56 | 36 | 64 |
| #2 | 41 | 59 | 31 | 69 |
| #3 | 49 | 51 | 34 | 66 |
| #4 | 53 | 47 | 25 | 75 |
| #5 | 78 | 22 | 26 | 74 |
| #6 | 59 | 41 | 52 | 48 |
| #7 | 49 | 51 | 62 | 38 |
| #8 | 44 | 56 | 63 | 37 |
| #9 | 42 | 58 | 46 | 54 |

Test Example 4

Improvement of Pleasure by Neck Care

The effect of the neck care on improvement of pleasure was tested by recording brain waves.

Electroencephalography records electrical activity of the brain to detect lesions or disorders of brain. According to oscillation frequencies, the brain waves are classified into delta (0.2-3.99 Hz), theta (4-7.99 Hz), alpha (8-12.99 Hz) and beta (13-30 Hz). These frequency bands are used as important standards for evaluating abnormalities.

Delta (0.2-3.99 Hz): Frequently occurs in process to normal adults in deep sleep or in babies.

Theta (4-7.99 Hz): Observed in calm or drowsy state. Occurs more frequently in young children than in adults. In particular, Fmθ, or the frequency range of 7-8 Hz, occurs when anxiety is relieved concentration increases.

Alpha (8-12.99 Hz): Frequently occurs and increases in relaxed and comfortable state. Increases more when more relaxed and comfortable.

Beta (13-30 Hz): Occurs in alert or conscious activities such as speaking. It is also closely related with anxious or tense state or the presence of visual, auditory, palate and olfactory stimulation.

The ratio of beta to alpha waves (b/a) is commonly used as an index of pleasure/displeasure. The smaller the b/a, the better is the pleasure.

8 subjects were randomly subjected from those who were aged in their 20s and 30s. Before and after performing neck care, the brain waves of the subjects were recorded using Neuronics (Mirae Engineering Co., Korea). The ratio of beta to alpha waves (b/a) was calculated and the change of pleasure before and after the neck care was compared.

Figure 5:
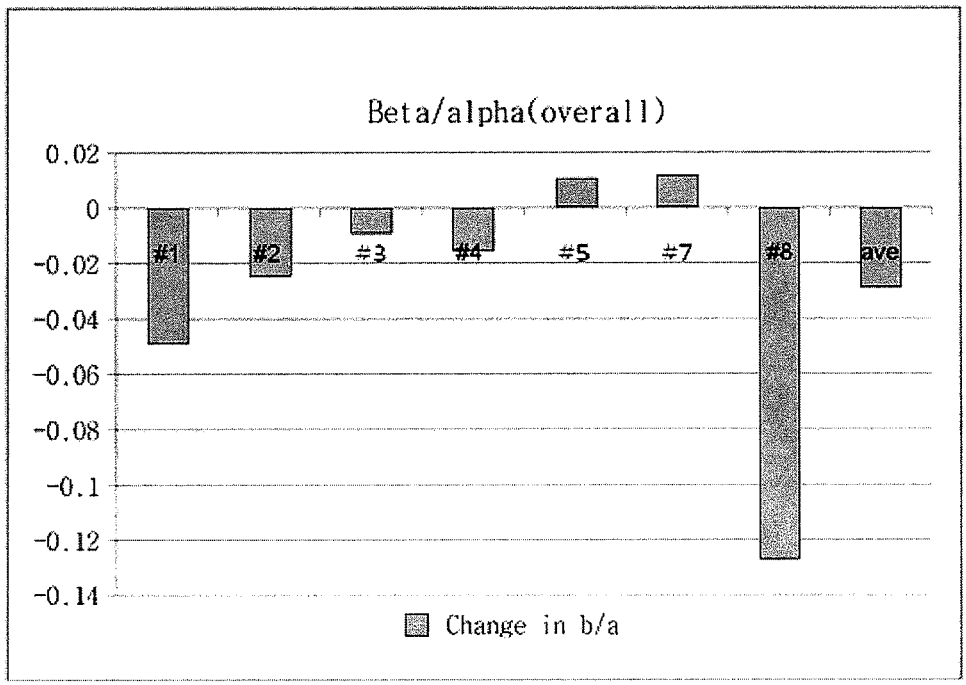
FIG. 5 shows the change in brain waves after performing neck care according to an embodiment of the present disclosure.

The test result is shown in FIG. 5. As seen from FIG. 5, data for 7 out of the 8 subjects were within the normal range. Among the 7 subjects who exhibited the normal results, 5 showed decrease in the ratio b/a. Thus, it can be seen that the neck care according to the present disclosure improves pleasure.

INDUSTRIAL APPLICABILITY

The method for neck care according to the present disclosure is considered to have effects of relieving skin wrinkles, improving blood circulation, relieving tension and giving a pleasant stimulation. Thus, it can be used in various applications in the fields of skin care, cosmetics and medicine.

We claim:

1. A method for neck care comprising:

applying a neck cream to a neck;

applying acupressure to a Cheonchu acupoint and then applying acupressure downward along a back neckline from the Cheonchu acupoint;

applying acupressure to a Yepung acupoint and then applying acupressure downward along a sternocleidomastoid muscle from the Yepung acupoint to an upper margin of a collarbone;

applying acupressure to the upper margin of the collarbone and a décolleté region (an upper part of breast); and applying acupressure to a region connecting a low margin of a lower jaw and the neck including a digastrics muscle, wherein said applying acupressure to the Yepung acupoint and then applying acupressure downward along the sternocleidomastoid muscle from the Yepung acupoint to the upper margin of the collarbone comprises applying acupressure to the Yepung acupoint and then applying acupressure successively to a Cheonchang acupoint, a Cheonyong acupoint and a Cheonyu acupoint on the sternocleidomastoid muscle, and wherein the neck cream comprises foxglove extract, *coix* seed extract, malt extract, quince extract, *acanthopanax* extract and arrowroot extract as an active ingredient.

2. The method of claim 1, wherein said applying acupressure to the Cheonchu acupoint and said applying acupressure to the Yepung acupoint are performed 3-10 times, respectively.

3. The method of claim 1, wherein the method for neck care is performed by a therapist on the therapist.

4. The method of claim 1, which is for skin care comprising improving skin condition.

* * * * *